US010487621B2

(12) United States Patent
Arabsky et al.

(10) Patent No.: US 10,487,621 B2
(45) Date of Patent: Nov. 26, 2019

(54) METHOD AND APPARATUS OF STEAM INJECTION OF HYDROCARBON WELLS

(71) Applicant: Interra Energy Services Ltd., Calgary (CA)

(72) Inventors: Serhiy Arabsky, Beaumont (CA); Vitaliy Arabsky, Beaumont (CA)

(73) Assignee: INTERRA ENERGY SERVICES LTD., Calgary, AB (CA)

( * ) Notice: Subject to any disclaimer, the term of this patent is extended or adjusted under 35 U.S.C. 154(b) by 185 days.

(21) Appl. No.: 15/312,575

(22) PCT Filed: May 19, 2015

(86) PCT No.: PCT/CA2015/000316
§ 371 (c)(1),
(2) Date: Nov. 18, 2016

(87) PCT Pub. No.: WO2015/176158
PCT Pub. Date: Nov. 26, 2015

(65) Prior Publication Data

US 2017/0101851 A1 Apr. 13, 2017

Related U.S. Application Data

(60) Provisional application No. 62/000,798, filed on May 20, 2014.

(51) Int. Cl.
*E21B 43/24* (2006.01)
*E21B 34/10* (2006.01)
(Continued)

(52) U.S. Cl.
CPC ..... *E21B 34/10* (2013.01); *E21B 34/063* (2013.01); *E21B 43/24* (2013.01); *E21B 43/2406* (2013.01); *E21B 2034/007* (2013.01)

(58) Field of Classification Search
CPC . E21B 43/24; E21B 2034/007; E21B 41/0078
See application file for complete search history.

(56) References Cited

U.S. PATENT DOCUMENTS 5,211,240 A 5/1993 Gadelle et al.
2009/0056934 A1* 3/2009 Xu ..... E21B 43/26 166/244.1
(Continued)

FOREIGN PATENT DOCUMENTS

CA 2 219 513 F 5/1999
CA 2 249 128 C 4/2000
(Continued)

OTHER PUBLICATIONS

International Search Report and Written Opinion dated Aug. 5, 2015, issued in corresponding International Application No. PCT/CA2015/000316, filed May 19, 2015, 6 pages.

*Primary Examiner* — Brad Harcourt

(57) ABSTRACT

A method and apparatus for the injection of steam into a hydrocarbon well during a Steam Assisted Gravity Drainage (SAGD) process are provided. The apparatus can include a shifting sleeve positioned within the body of the apparatus. The shifting sleeve can have an open and a closed position. In the closed position annular seals can substantially prevent steam within the bore of the body from exiting the device and flowing into the wellbore. When the shifting sleeve is moved to its open position, an aperture in the body aligned with a steam dispersing cover mounted on the body can be exposed to pressurized steam from the bore of the apparatus and can allow steam to exit the bore and be dispersed into the wellbore. The steam dispersing covers can have dispersion openings which can direct the steam into the wellbore as desired.

17 Claims, 11 Drawing Sheets

(51) Int. Cl.
*E21B 34/06* (2006.01)
*E21B 34/00* (2006.01)

(56) References Cited

U.S. PATENT DOCUMENTS

| | | | | |
|---|---|---|---|---|
| 2011/0094727 | A1* | 4/2011 | Sims | E21B 43/2406 166/57 |
| 2011/0139453 | A1 | 6/2011 | Schultz et al. | |
| 2012/0145398 | A1 | 6/2012 | Schultz et al. | |
| 2013/0186623 | A1 | 7/2013 | Waterhouse et al. | |
| 2016/0333664 | A1* | 11/2016 | Ismail | E21B 41/0078 |

FOREIGN PATENT DOCUMENTS

| | | | |
|---|---|---|---|
| CA | 2 478 885 | C | 9/2003 |
| CA | 2 618 181 | C | 7/2008 |
| CA | 2 694 146 | C | 2/2009 |
| CA | 2 743 381 | C | 5/2010 |
| CA | 2 782 343 | C | 6/2011 |
| CA | 2 794 539 | C | 10/2011 |
| CA | 2 769 044 | A1 | 2/2012 |
| CA | 2 730 875 | C | 8/2012 |
| CA | 2 794 302 | C | 5/2013 |
| CA | 2 765 812 | C | 7/2013 |
| CA | 2 828 848 | C | 7/2013 |
| CA | 2 917 392 | A1 | 2/2015 |
| CA | 2 821 264 | C | 6/2016 |

* cited by examiner

METHOD AND APPARATUS OF STEAM INJECTION OF HYDROCARBON WELLS

CROSS REFERENCE TO RELATED APPLICATIONS

This application claims priority of U.S. Provisional Patent Application Ser. No. 62/000,798, entitled "Method and Apparatus of Steam Injection of Hydrocarbon Wells", filed May 20, 2014, and hereby incorporated by reference herein in its entirety.

TECHNICAL FIELD

The present disclosure is related to the field of methods and apparatus used in hydrocarbon wells, in particular, methods and apparatus for use during steam injection of hydrocarbon wells.

BACKGROUND

There are several methods for recovering viscous oil and bitumen from underground heavy oil deposits. One such method is known as Steam Assisted Gravity Drainage (SAGD). During the SAGD process a pair of coextensive horizontal wells, spaced one above the other, are drilled close to the base of a viscous oil or bitumen deposit. The span of the formation between the wells is heated by thermal conductance using the circulation of steam through each of the wells to mobilize the bitumen located therebetween.

Once the bitumen is sufficiently heated the oil may be displaced or driven from one well to the other. This fluid communication is achieved by injecting steam through the steam injection well (usually the upper well) at less than fracture pressure, and opening the production well (usually the lower well), so that it can collect the draining liquid. The injected steam forms a steam chamber in the formation which continues to heat the formation, reducing the viscosity of the oil and increasing its mobility. This increase in mobility allows the heated oil to drain downwardly, through the force of gravity, towards the production well.

A steam generator located at the surface of the steam injection well generates and injects steam down a steam tubular. The steam is released from the steam tubular through exit ports and flows into the steam injection wellbore and then moves outward into the formation. The steam tubular may have several steam splitters, which distributes the steam in predetermined sections in the well. Typically, a steam splitter can be opened and closed based on the steam requirements during the SAGD operation.

In prior devices, the steam released from the steam tubular is unevenly dispersed at the exit ports or flows directly outward (radially) from the body of the steam tubular. This can result in the steam damaging and eroding the wellbore or damaging and creating holes in the liner of the steam injection wellbore.

The steam splitter described in Canadian Patent Number 2,765,812 has a shroud that surrounds the exit ports and the tubular and unevenly funnels the steam over the front and back of the tool, potentially causing damage to the wellbore. The use of a shroud results in uneven, uncontrolled distribution of steam. The steam from each exit port is grouped, forced to exit at common exits of the shroud, and is sent out in an untargeted, unpredictable manner.

Some known steam splitters only provide open and closed exit port positions and they do not allow an operator to customize the size or position of the holes or exit ports through which the steam escapes into the steam injection wellbore. Further, some steam splitters direct the flow of steam through the tool in such a manner that it may shorten the life of the tool itself. For example, the flow of steam in the tool described by Canadian Patent Number 2,765,812 travels through a shifting sleeve. This can cause damage to the shifting sleeve through erosion and reduce the lifespan of the tool.

Improved dispersion of steam is desirable to overcome the limitations in the known devices and to reduce potential erosion of both the tool and the steam injection wellbore.

SUMMARY

A method and apparatus for the injection of steam into a hydrocarbon well during a SAGD process are provided. The apparatus can include a shifting sleeve positioned within the body of the apparatus. The shifting sleeve can have an open and a closed position. In the closed position annular seals can substantially prevent steam within the bore of the body from exiting the device and flowing into the wellbore. When the shifting sleeve is moved to its open position, an aperture in the body, aligned with a steam dispersing cover mounted on the body, can be exposed to pressurized steam from the bore of the apparatus and can allow steam to exit the bore and be dispersed into the wellbore. The steam dispersing covers can have dispersion openings which can direct the steam into the wellbore as desired.

Broadly stated, in some embodiments, an apparatus is provided for dispersing steam in hydrocarbon wells having a wellbore, the apparatus comprising: a tubular body having at least two apertures positioned around the outer circumference of the body; and a steam dispersing cover, aligned with each of the at least two apertures, each steam dispersing cover having at least one dispersion opening for directing the flow of steam into the wellbore; wherein when steam is provided through the tubular body, steam exits the at least two apertures through the at least two steam dispersing covers and is dispersed through the at least one dispersion opening into the wellbore.

In some embodiments, the apparatus can further comprising a shifting sleeve disposed within the body, the shifting sleeve being moveable between first and second positions, wherein when the shifting sleeve is in the first position, steam is prevented from exiting the tubular body and when the shifting sleeve is in the second position, steam from the bore of the tubular body can exit the body through the at least two apertures and be dispersed into the wellbore. In some embodiments, the apparatus can further comprise first and second seals positioned on the shifting sleeve so that the first and second seals straddle the at least two apertures when the shifting sleeve is in the first position, and so that the first and second seals are both positioned on one side of the at least two apertures when the shifting sleeve is in the second position. In some embodiments, the first and second seals are annular seals.

In some embodiments, the steam dispersing cover can comprise a tortuous path between one of the at least two apertures and the at least on dispersion opening. In some embodiments, the shifting sleeve can comprise at least one shear pin for holding the shifting sleeve in the first position subject to a shifting force. In some embodiments, the shifting sleeve can comprise a tension response mechanism for holding the shifting sleeve in the second position.

Broadly stated, in some embodiments, a steam dispersing cover is provided for use with an apparatus having a tubular body for dispersing steam in hydrocarbon wells having a wellbore, the steam dispersing cover comprising: at least one dispersion opening for directing the flow of steam into the wellbore; and means for aligning the steam dispersing cover with an aperture positioned around the outer circumference of the tubular body.

In some embodiments, the steam dispersing cover can further comprise a tortuous path for leading from the aperture and the at least on dispersion opening.

Broadly stated, in some embodiments, a method is provided for dispersing steam in hydrocarbon wells having a wellbore, the method comprising: pumping steam through an apparatus comprising a tubular body having at least two apertures positioned around the outer circumference of the body; and a steam dispersing cover, aligned with each of the at least two apertures, each steam dispersing cover having at least one dispersion opening for directing the flow of steam into the wellbore; wherein when steam is provided through the tubular body, steam exits the at least two apertures through the at least two steam dispersing covers and is dispersed through the at least one dispersion opening into the wellbore; and dispersing steam out the dispersion openings and into the wellbore.

In some embodiments, the method can further comprise moving a shifting sleeve from its first position to its second position. In some embodiments, the method can further comprise shearing at least one shear pin holding the shifting sleeve in the first position with a shifting force. In some embodiments, the shifting force can be provided by a shifting tool. In some embodiments, the shifting force can be provided by downhole pressure. In some embodiments, the method can further comprise holding the shifting sleeve in the second position with a tension response mechanism.

DETAILED DESCRIPTION OF EMBODIMENTS

Figure 1:
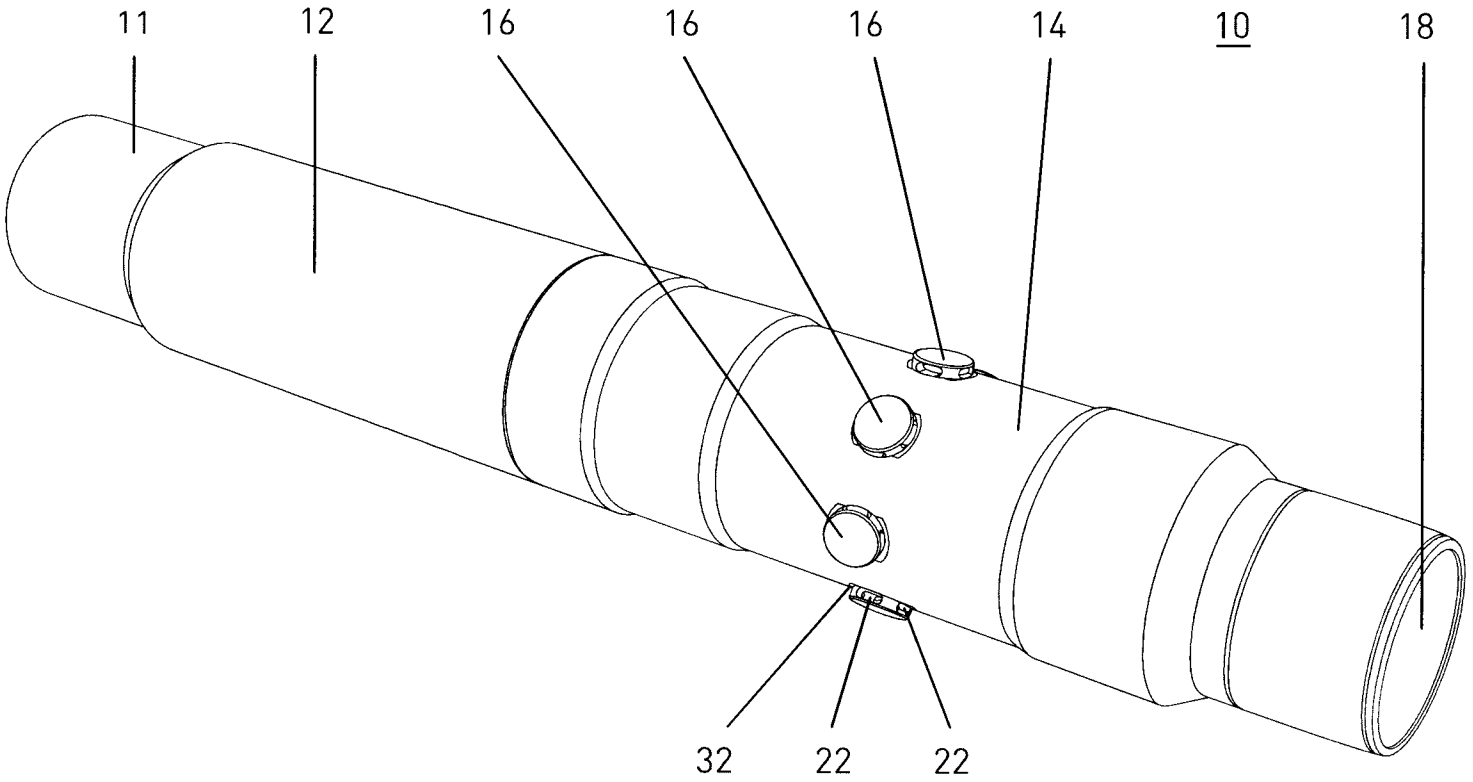
FIG. 1 is a side perspective view of an embodiment of a device for the injection of steam into a hydrocarbon well.

An apparatus and method for dispersing steam in hydrocarbon wells during Steam Assisted Gravity Drainage (SAGD) operation are provided herein. The apparatus can be a device that is able to shift between open and closed positions such that when in a closed position steam can travel through the bore 18 of the tubular body 11 of device 10 and when in an open position the steam can be dispersed from bore 18 into wellbore through at least one exit port 32. Each exit port 32 can comprise an aperture 20 in lower housing 14 segment of device 10 and a steam dispensing cover (or cap) 16 mounted on the lower housing 14 and aligned with aperture 20. Each steam dispensing cover 16 can have at least one dispersion opening 22 for directing the flow of steam into the wellbore.

Referring to FIG. 1, an embodiment of a steam injection device 10 is shown with a body 11, having an upper housing 12 and a lower housing 14, with bore 18 running throughout. Disposed on the outer circumference of the lower housing 14 can be at least one steam dispensing cover 16.

Figure 2A:
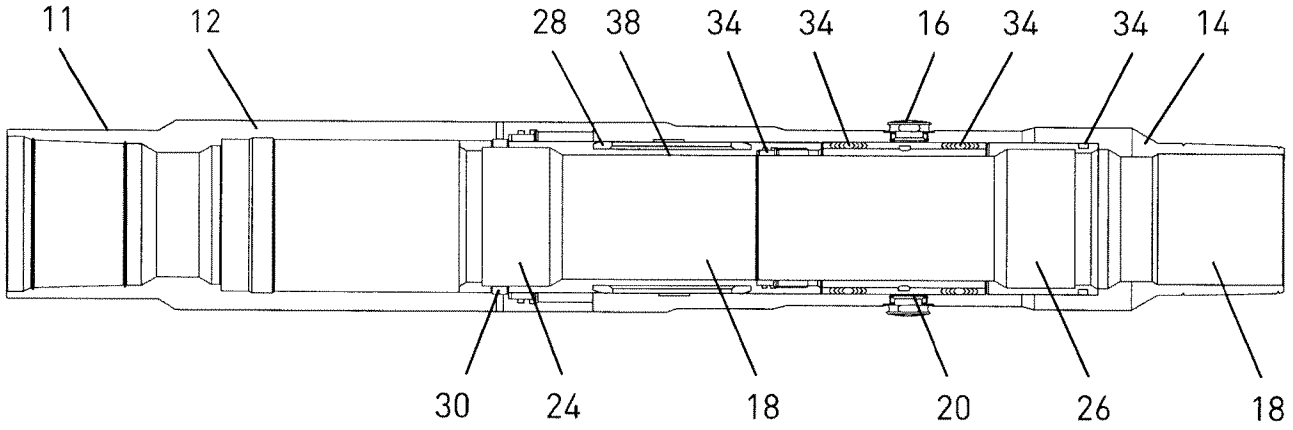
FIGS. 2A and 2B are side cross-sectional views the embodiment shown in FIG. 1, in closed and open positions, respectively.

Referring to FIG. 2A, a shifting sleeve 38 can be disposed inside body 11, which can move between open and closed positions. Shown in FIG. 2A, seals 34 can be disposed around shifting sleeve 38. In some embodiments, seals 34 can be annular seals. In a closed position, seals 34 can be located both uphole and downhole of the at least one aperture 20, in order to straddle aperture 20 in lower housing 14 and can be configured to substantially prevent steam from escaping the bore 18 of the device 10 and travelling into the wellbore (not shown).

Figure 2B:
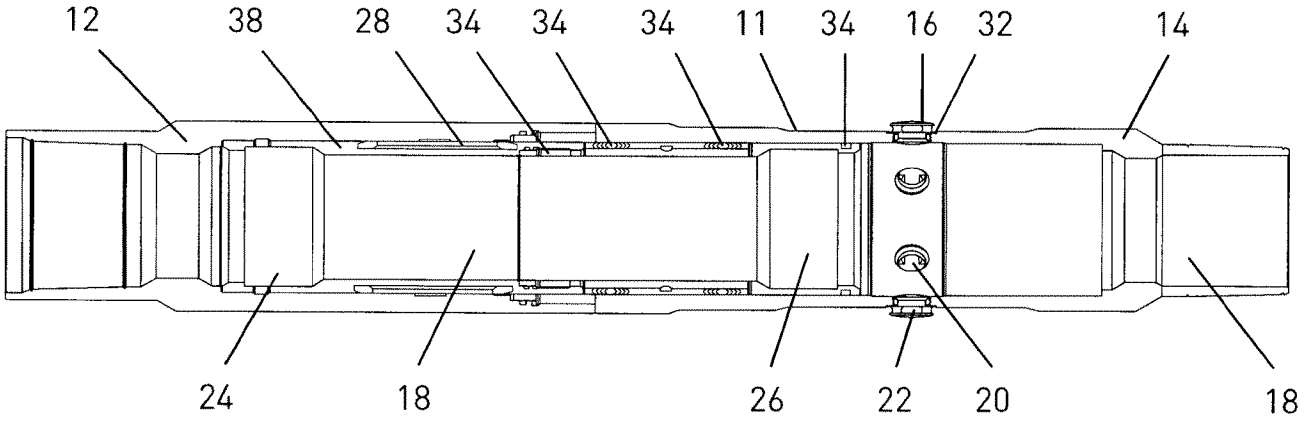

Shifting sleeve 38 can have first and second shifting profiles, 24 and 26 respectively, and can be shifted from a closed position (FIG. 2A) to an open position, as shown in FIG. 2B. In the open position, seals 34 can be located uphole of the at least one aperture 20 allowing the at least one aperture 20 and the aligned steam dispersing cover 16 to be in fluid communication with bore 18. This opening and alignment can allow steam traveling through bore 18 of device 10 to exit through the at least one exit port 32, so that there can be fluid communication between bore 18 and the wellbore.

In the open position, shifting sleeve 38 can be moved away from the at least one aperture 20 to reduce potential erosion to the shifting mechanism due to the flow of steam, thereby lengthening the longevity of the device.

Figure 3:
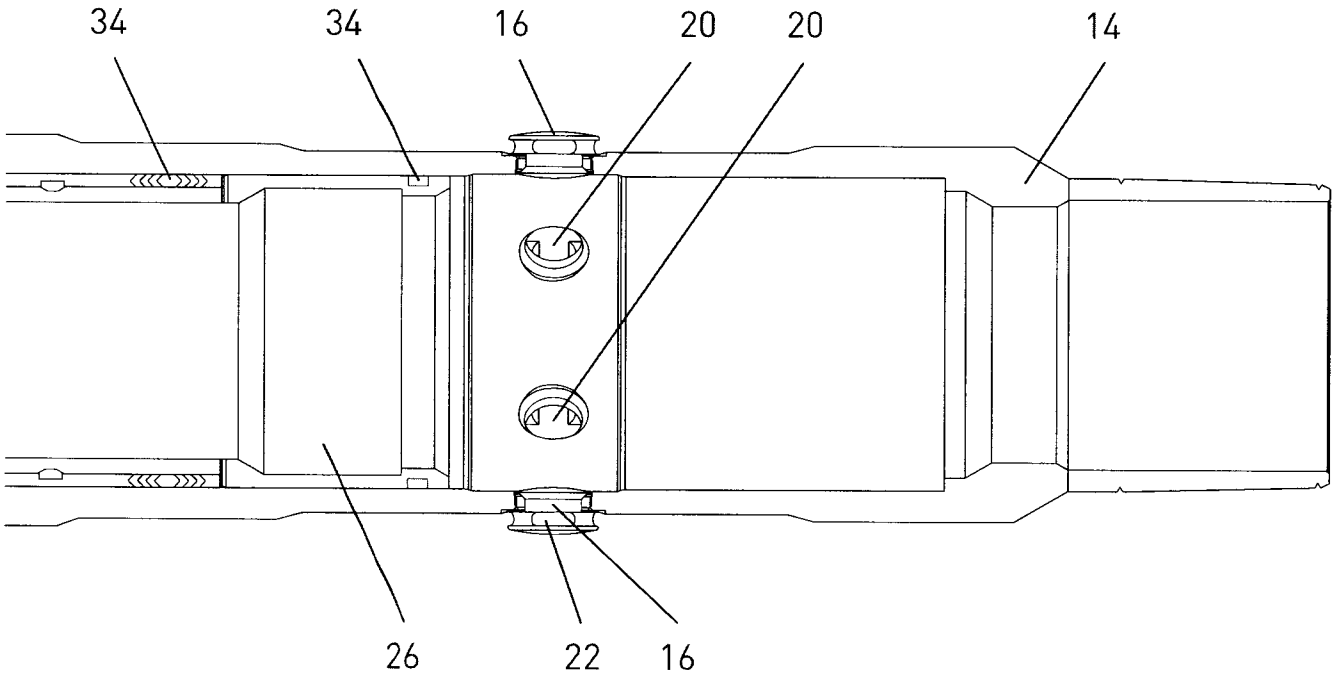
FIG. 3 is a close-up cross-sectional view of the embodiment of FIG. 2B.
Figure 4:
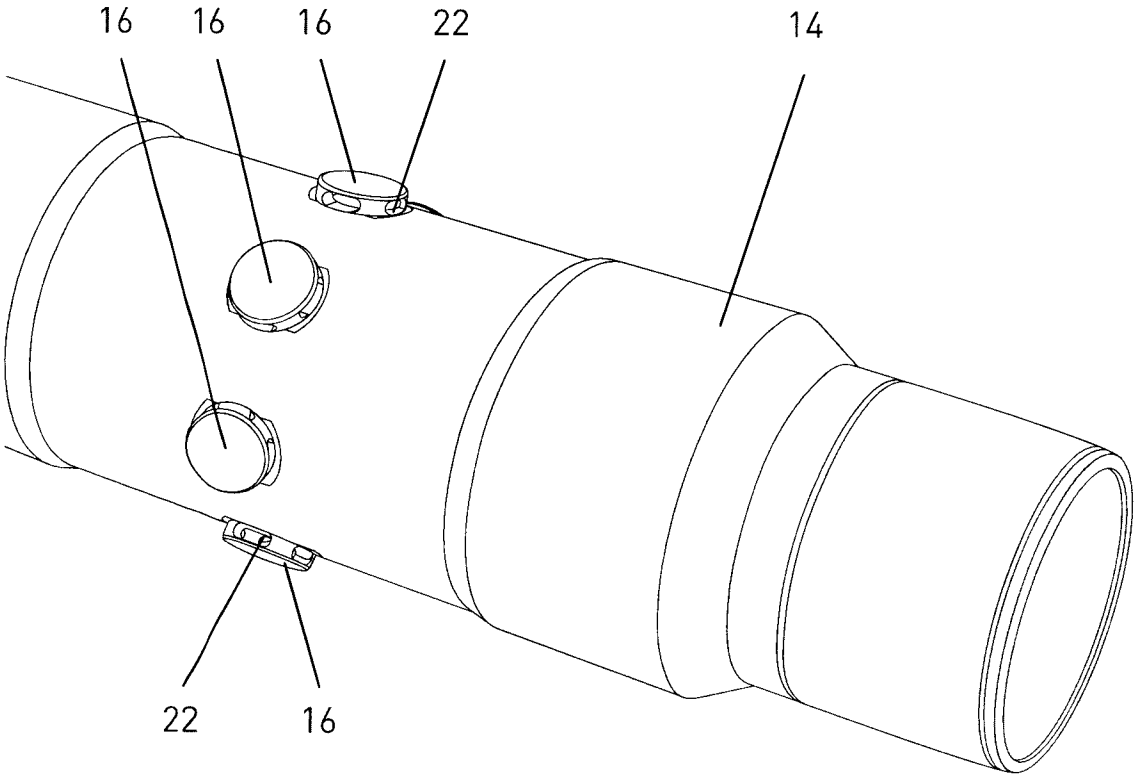
FIG. 4 is a perspective close-up view of the lower section of the embodiment of FIG. 1.

FIG. 3 and FIG. 4 depict a close-up view of an embodiment of a lower housing 14 configuration internally and externally, respectively.

Steam dispersing cover 16 can be configured and/or designed to redirect and disperse steam into the wellbore, but prevent it from directly exiting into the wellbore radially from body 11, which can cause damage to the wellbore itself and/or its lining.

Figure 5A:
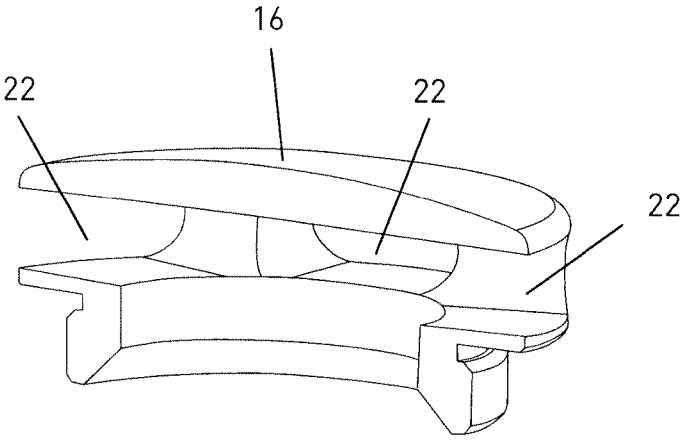
FIG. 5A is a perspective close-up cross-sectional view of an embodiment of a steam dispensing cover.
Figure 5B:
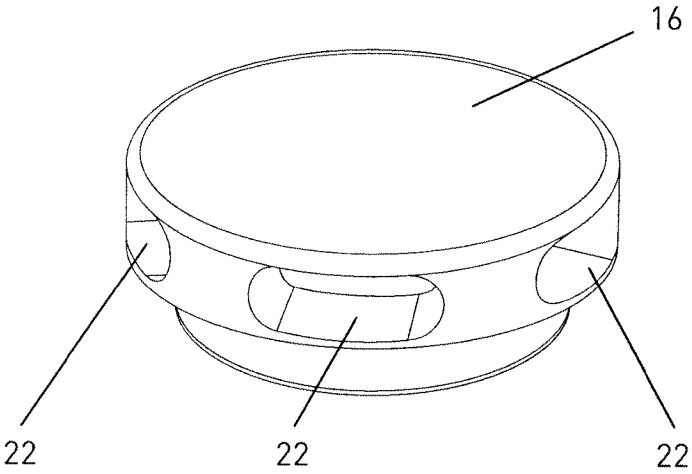
FIG. 5B a perspective close-up view of the steam dispensing cover shown in FIG. 5A.
Figure 6:
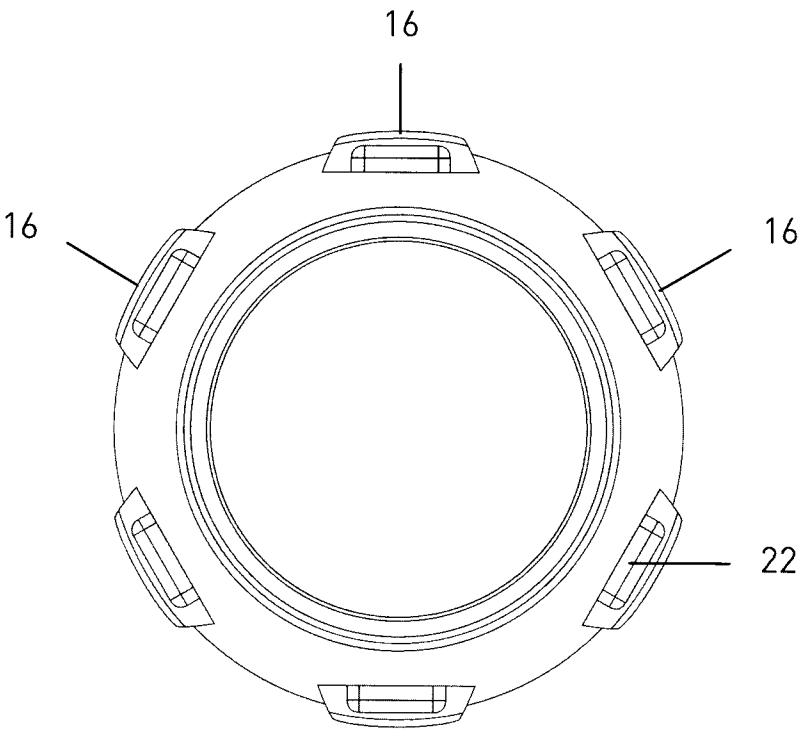
FIG. 6 is an end view looking uphole of an embodiment of a device for the injection of steam into a hydrocarbon well.

In some embodiments, shown in FIG. 5, steam dispersing cover 16 can be generally round in nature with at least one dispersion opening 22. A cap-shaped embodiment of a cover can allow steam to be dispersed into the wellbore in multiple directions, without being directed radially onto the inner surface of the wellbore. In FIGS. 1-4 and 6, steam dispersing covers 16 are shown generally evenly spaced around the outer surface of lower housing 14 in a ring shape. However, a skilled person would understand that there may be any number of steam dispersing covers, and they may be differently spaced or positioned in body 11 depending on the location of the apertures 20 and the desired flow of steam into the wellbore.

Figure 7:
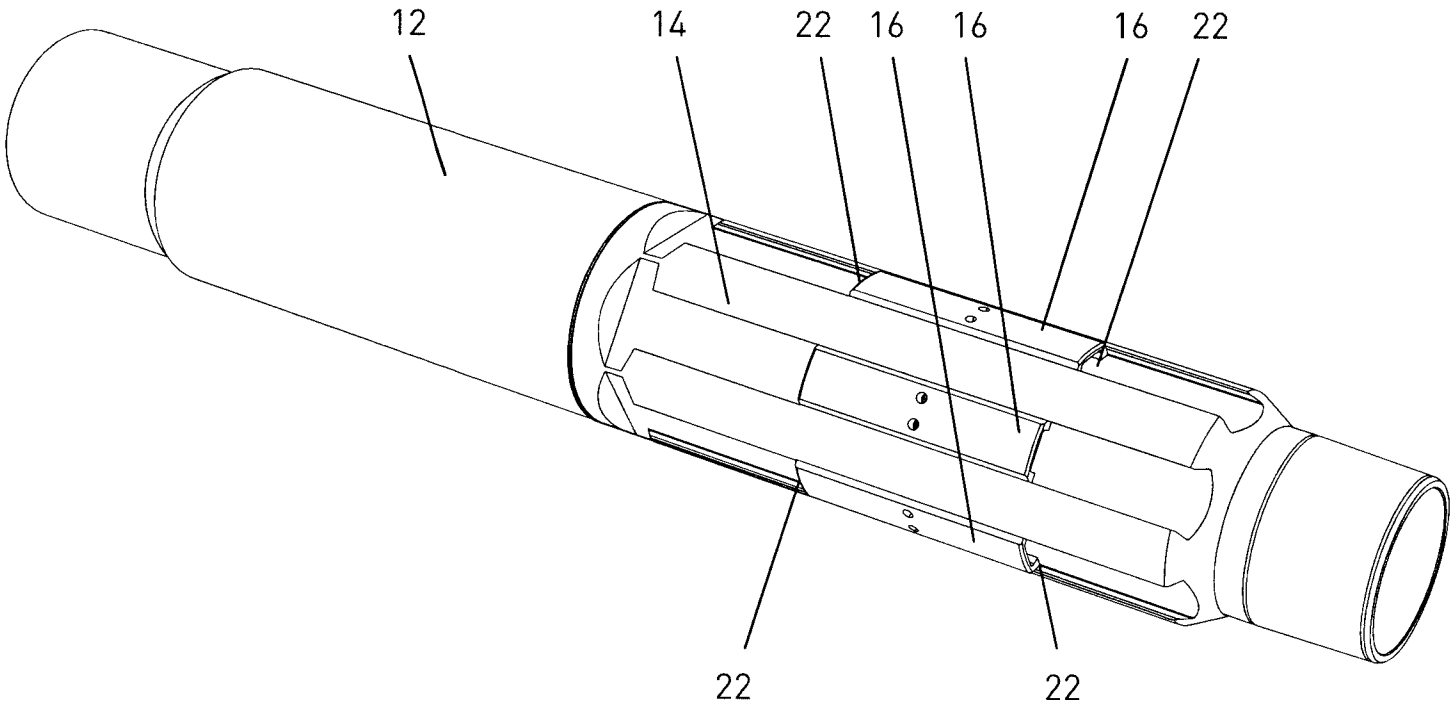
FIG. 7 is a side perspective view of an embodiment of a device for the injection of steam into a hydrocarbon well.
Figure 8:
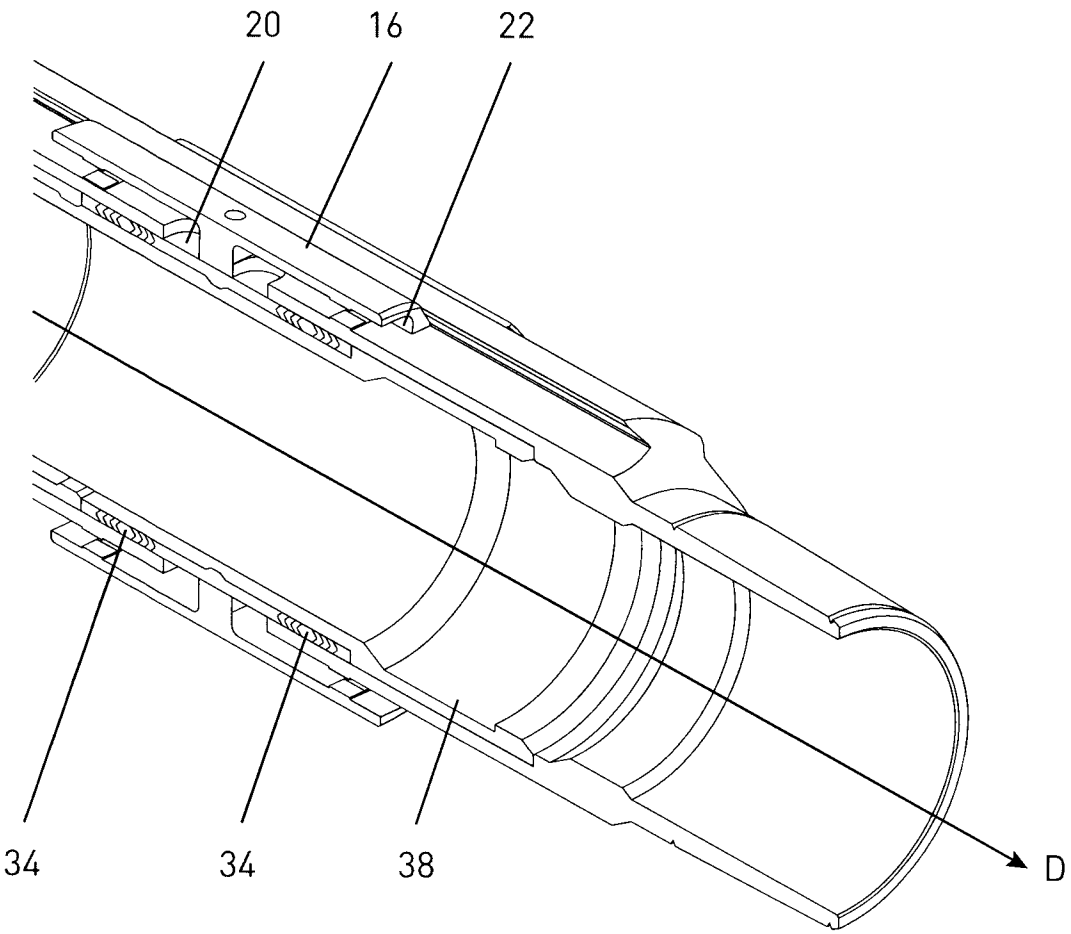
FIG. 8 is a perspective cross-sectional close-up view of the lower section of the embodiment shown in FIG. 7 in a closed configuration.
Figure 9:
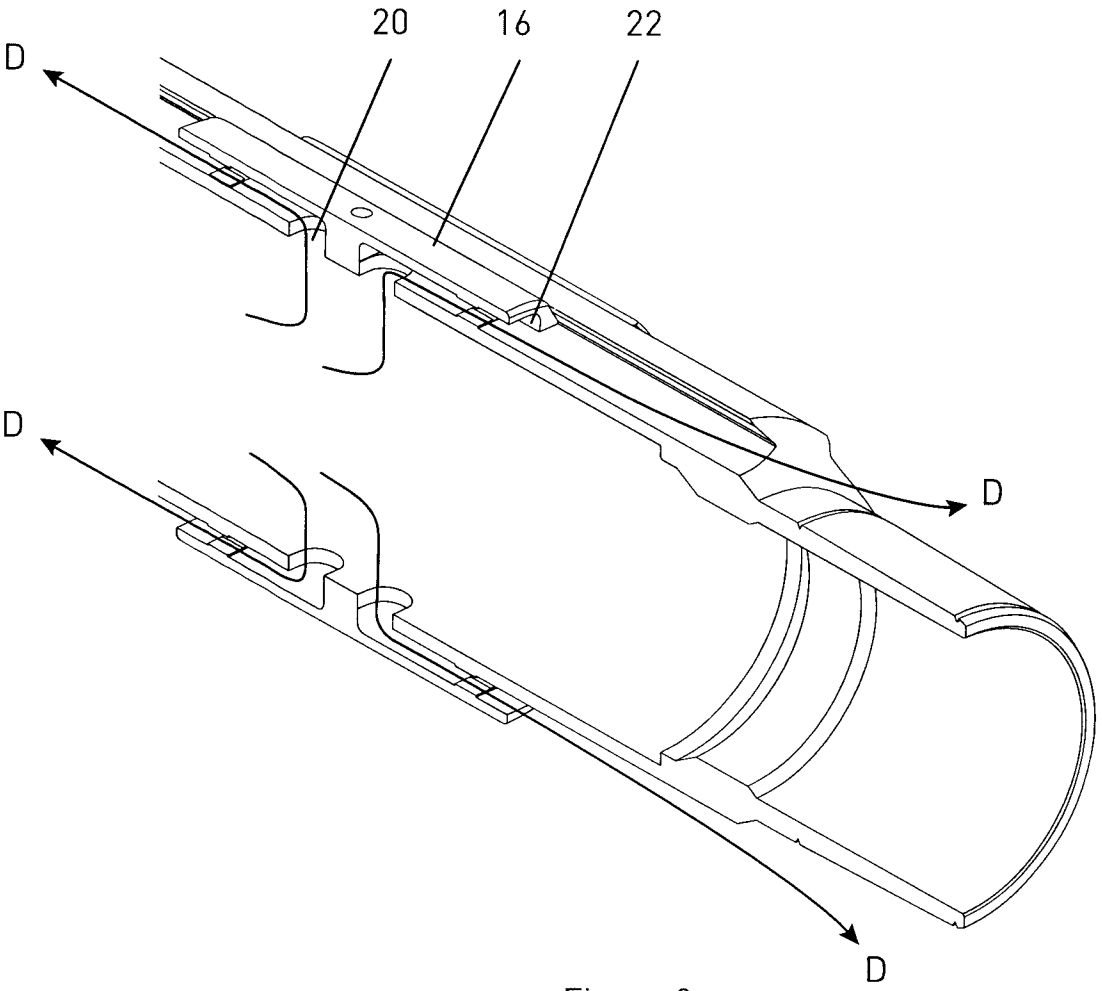
FIG. 9 is a perspective cross-sectional close-up view of the lower section of the embodiment shown in FIG. 7 in an open configuration.

In some embodiments of device 10, shown in FIGS. 7 and 8, steam dispersing covers 16 can be generally rectangular in shape and direct the steam downhole and/or uphole of device 10, but prevent it from directly exiting into the wellbore radially from body 11.

Steam dispersion covers 16 can be mounted onto body 11 using mounting means such as screws, a dove tail design or any other means known to a skilled person that would keep steam dispersion cover 16 mounted in position on body 11. In some embodiments, covers 16 can be removable and/or replaceable for repairs and/or maintenance.

In some embodiments, each steam dispersing cover 16 can be independently controlled by an operator using a choke, so that the flow of steam can be regulated as needed.

In some embodiments the flow of steam can also be modified by changing the size of aperture 20 in body 11, or placing them at an angle to reduce the tortuous path that the steam has to flow through, thereby further reducing potential erosion.

Figure 10:
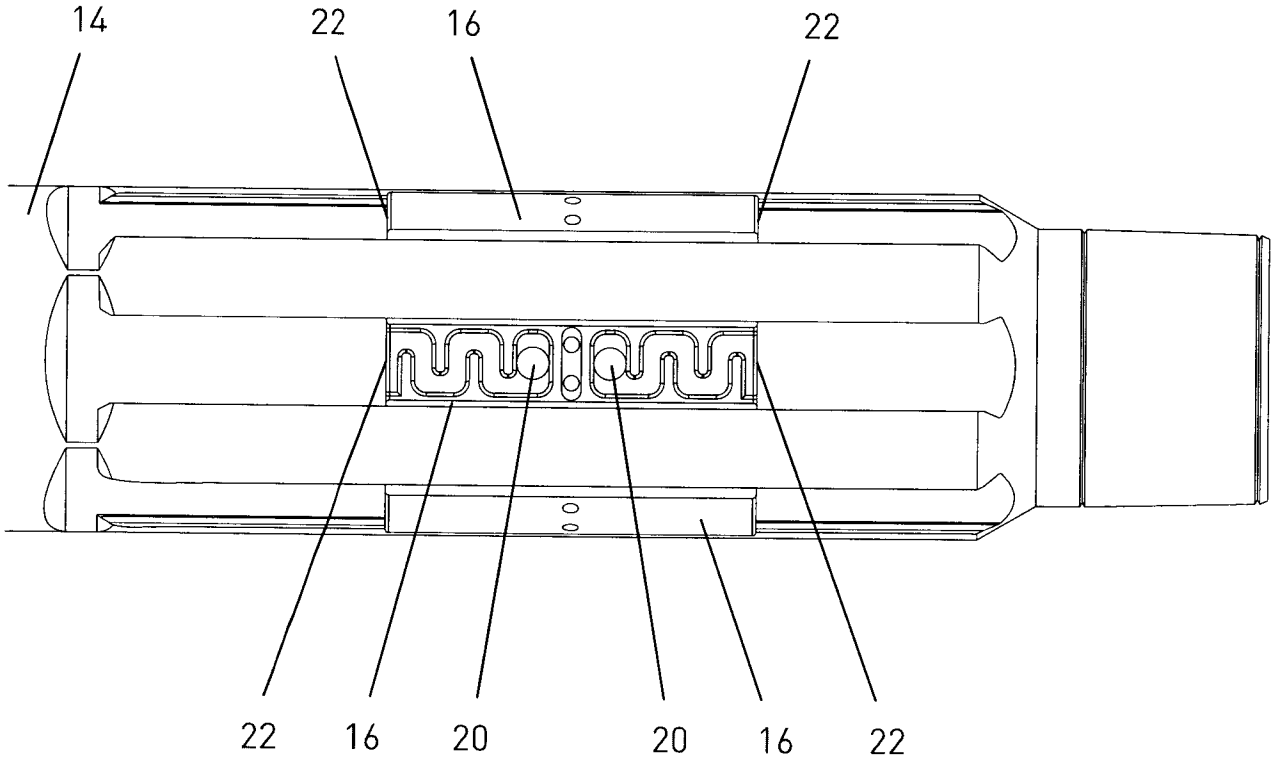
FIG. 10 is a close-up, partial cross-sectional view of the embodiment of FIG. 7.
Figure 11B:
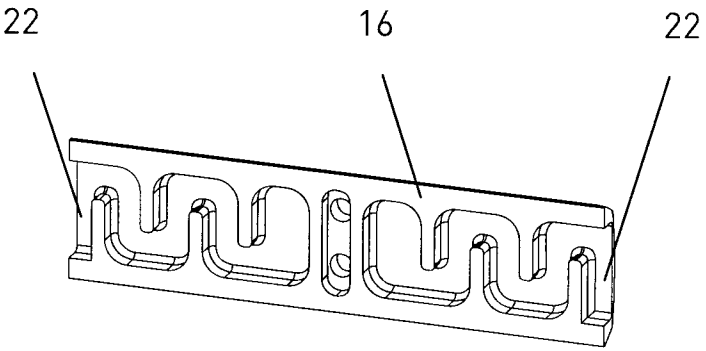
FIG. 11B a perspective close-up bottom view of the steam dispensing cover shown in FIG. 11A.
Figure 11A:
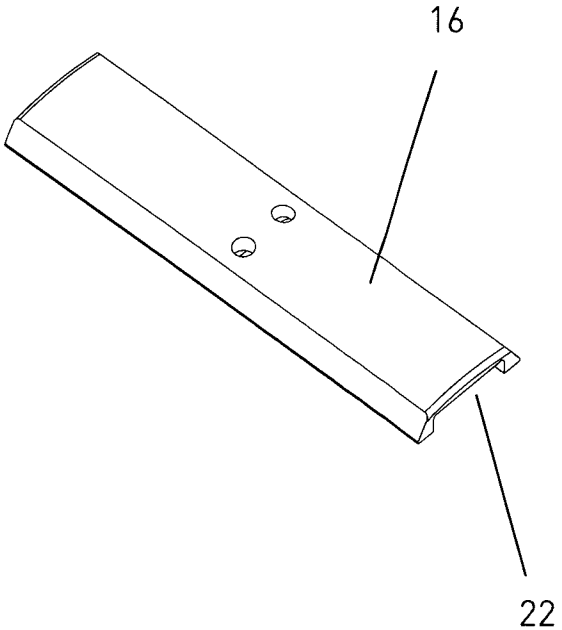
FIG. 11A is a perspective close-up view of an embodiment of a steam dispensing cover.

In some embodiments, device 20 can use a tortuous path to achieve the desired control and dispersion of steam. In some embodiments, cover 16 can be configured to have an integral tortuous path that would lead the steam from aperture 20 to dispersion opening 22. For illustrative purposes, an example of a tortuous path is shown in FIG. 10 and FIG. 11B. In some embodiments, the tortuous path can be similar to a maze. The use of a tortuous path can allow for a choke on the steam without having to reduce the size of either aperture 20 or dispersion opening 22. In some embodiments, each cover 16 can be configured to have a different tortuous path to allow for varying levels of control and flexibility of steam pressure and velocity at each aperture 20.

In some embodiments, shifting sleeve 38 can be moved from a closed position in which apertures 20 of lower housing 14 are blocked. As such, steam provided to bore 18 cannot exit device 10 into the wellbore. In some embodiments, shifting sleeve 38 can be held in place by one or more shear pin(s) 30. In response to a predetermined level of pressure, and/or through the use of a shifting tool, shifting sleeve 38 can be moved into an open position (FIG. 2B) in which apertures 20 of lower housing 14 can be exposed. Such a shifting tool can be configured to open or close device 10. In some embodiments, shear pin(s) 30 are sheared to allow this shift. As such, steam provided to bore 18 can exit device 10 into the wellbore through apertures 20. In some embodiments, tension response mechanism 28 can be used to lock or hold shifting sleeve 38 in place, for example in an open position.

In operation, steam can be provided from the surface, for example by a pump or injector, into device 10 and can travel through bore 18. Shifting sleeve 38 can be moved from its first position to its second position to allow aperture(s) 20 in body 11 to be exposed, opened, and in fluid communication with bore 18. Steam can be dispersed into the wellbore as it travels through aperture(s) 20, dispersed by covers 16, and out dispersion opening(s) 22.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. An apparatus for dispersing steam in hydrocarbon wells having a wellbore, the apparatus comprising:

a tubular body configured to communicate steam through the tubular body;

at least two apertures positioned around an outer circumference of the tubular body, the apertures operable for fluid communication of steam from inside the tubular body to outside the tubular body; and a separate rectangular-shaped steam dispersing cover for each aperture, the steam dispersing cover mounted on an outer surface of the tubular body and having a first dispersion opening positioned on a downhole end of the cover and a second dispersion opening positioned on an uphole end of the cover and configured to be in alignment with the aperture and operable for dispersing steam directly exiting the aperture into the wellbore through the first dispersion opening and the second dispersion opening without steam being directed radially onto an inner surface of the wellbore.

2. The apparatus of claim 1, further comprising a shifting sleeve disposed within the body, the shifting sleeve being moveable between first and second positions, wherein when the shifting sleeve is in the first position, the communication of steam from inside the tubular body is prevented from exiting the tubular body and when the shifting sleeve is in the second position, steam from inside the tubular body can exit the tubular body through each aperture and steam dispersing cover and be dispersed through the first dispersion opening and the second dispersion opening into the wellbore.

3. The apparatus of claim 2, further comprising first and second seals positioned on the shifting sleeve so that the first and second seals straddle the at least two apertures when the shifting sleeve is in the first position, and so that the first and second seals are both positioned on one side of the at least two apertures when the shifting sleeve is in the second position.

4. The apparatus of claim 3, wherein the first and second seals are annular seals.

5. The apparatus of claim 2, wherein the shifting sleeve comprises at least one shear pin for holding the shifting sleeve in the first position subject to a shifting force.

6. The apparatus of claim 1, wherein the steam dispersing cover comprises a tortuous path between the aperture and the first dispersion opening and the second dispersion opening.

7. A method for dispersing steam in hydrocarbon wells having a wellbore, the method comprising:

pumping steam through an apparatus according to claim 1; and dispersing steam out the dispersion openings and into the wellbore.

8. The method of claim 7, wherein the apparatus further comprises a shifting sleeve disposed within the tubular body, the shifting sleeve being moveable between first and second positions, wherein when the shifting sleeve is in the first position, the communication of steam from inside the tubular body is prevented from exiting the tubular body and when the shifting sleeve is in the second position, steam from inside the tubular body can exit the tubular body through each aperture and steam dispersing cover and be dispersed through the first dispersion opening and the second dispersion opening into the wellbore.

9. The method of claim 8, wherein the apparatus further comprises first and second seals positioned on the shifting sleeve so that the first and second seals straddle the at least one aperture when the shifting sleeve is in the first position, and so that they are both positioned on one side of the at least one aperture when the shifting sleeve is in the second position.

10. The method of claim 9, wherein the first and second seals are annular seals.

11. The method of claim 8, further comprising shearing at least one shear pin holding the shifting sleeve in the first position with a shifting force.

12. The method of claim 11, wherein the shifting force is provided by a shifting tool.

13. The method of claim 11, wherein the shifting force is provided by downhole pressure.

14. The method of claim 7, further comprising moving the shifting sleeve from its first position to its second position.

15. The method of claim 7, further comprising recovering oil from the wellbore.

16. A steam dispersing device for dispersing steam in hydrocarbon wells having a wellbore, the steam dispersing device comprising:

a rectangular-shaped cover having a first dispersion opening positioned on a downhole end of the cover and a second dispersion opening positioned on an uphole end of the cover; and means for aligning the cover with one aperture positioned around an outer circumference of a tubular body in fluid communication with steam, the aperture being operable for fluid communication of steam from inside the tubular body to outside the tubular body, and means for mounting the cover on an outer surface of the tubular body, wherein in operation the cover and the first dispersion opening and the second dispersion opening are operable for dispersing steam into the wellbore directly exiting the aperture downhole and uphole of the cover without steam being directed radially onto an inner surface of the wellbore.

17. The steam dispersing device of claim 16, wherein the steam dispersing device comprises a tortuous path between the aperture and the first dispersion opening and the second dispersion opening.

* * * * *